US006692373B2

(12) United States Patent
Hultquist

(10) Patent No.: US 6,692,373 B2
(45) Date of Patent: Feb. 17, 2004

(54) GOLF BALL POSITIONING DEVICE

(76) Inventor: Tim L. Hultquist, P.O. Box 316, Magna, UT (US) 84044

( * ) Notice: Subject to any disclaimer, the term of this patent is extended or adjusted under 35 U.S.C. 154(b) by 0 days.

(21) Appl. No.: 10/071,478

(22) Filed: Feb. 6, 2002

(65) Prior Publication Data

US 2003/0148832 A1 Aug. 7, 2003

(51) Int. Cl.[7] ..... A63B 57/00
(52) U.S. Cl. ..... 473/285; 493/406
(58) Field of Search ..... 473/285, 406; 294/19.1

(56) References Cited

U.S. PATENT DOCUMENTS 1,756,141 A * 4/1930 Spellmeyer ..... 473/285
2,892,633 A * 6/1959 Eckert ..... 473/285
4,530,500 A 7/1985 Kaymen ..... 473/406
4,533,752 A 8/1985 Benkeser et al. ..... 473/300
4,553,752 A * 11/1985 Bagg ..... 473/285
5,527,038 A 6/1996 Mabie ..... 473/232
6,139,440 A 10/2000 Taylor ..... 473/131

FOREIGN PATENT DOCUMENTS

CA 522100 * 2/1956 ..... 273/32 A

* cited by examiner

*Primary Examiner*—Steven Wong
(74) *Attorney, Agent, or Firm*—Lloyd W. Sadler

(57) ABSTRACT

A golf ball location marker is provided that provides controlled release of a powder under user control for marking the location of a golf ball on a green in a manner so as to avoid the possibility of interfering with subsequent golf putts, while precisely marking the ball's location and without permanently marking the green or causing harm to the green. Several embodiments of this invention are provided, specifically for use as a hand-held device, or alternatively as installed in the end of a golf club or a walking stick or pole.

20 Claims, 4 Drawing Sheets

GOLF BALL POSITIONING DEVICE

BACKGROUND OF INVENTION

1. Field of the Invention

This relates to devices for marking the position of a golf ball during the game of golf. More specifically, this invention relates to devices for marking the position of a golf ball, which provides for the dispensing of a powder for marking the position of the golf ball on a green.

2. Description of Related Art

A variety of devices have been proposed for the marking of a golf ball, typically on the green of a golf course. Generally, these devices either do not facilitate the use of a powder for marking or do not adequately address the control of the quantity of powder used.

The following U.S. patent documents are referred to the reader as either relevant to the consideration of this invention or as applicable as general background material.

U.S. Pat. No. 4,530,500 describes a combination storage device and marker to mark the position of a golf ball resting on a putting green that can be worn on the waistband of slacks or skirt.

U.S. Pat. No. 4,553,752 describes a golf club handle that includes a powder-carrying chamber, which may be opened or closed by movement of a brush-carrying cap.

U.S. Pat. No. 5,527,038 describes a golf swing teaching aid golf club.

U.S. Pat. No. 6,139,440 describes a cartridge holder for a ballistic impeller golf club of the type having a piston and an explosive charge disposed within the head of the golf club.

Each of these U.S. patents is hereby incorporated in its entirety for the material contained therein.

SUMMARY OF INVENTION

It is desirable to provide a device for marking the position of a golf ball during a game of golf. In particular, it is desirable to provide a golf ball position-marking device that uses a biodegradable powder as a marking agent and which provides an easy consistent means of use.

Therefore, it is an object of this invention to provide a golf ball position-marking device that uses a biodegradable powder as a marking agent.

Another object of this invention is to provide a golf ball position-marking device that in one preferred embodiment is a hand held device.

It is a further object of this invention to provide a golf ball position marking device that in a second preferred embodiment is part of the handle of a golf club assembly.

A still further object of this invention is to provide a golf ball position-marking device that provides for a generally consistent dispersal of powder.

These and other objects of this invention will be readily apparent to those of ordinary skill in the art upon review of the following drawings, detailed description and claims. The objects and advantages of this invention may be realized and attained by the means of the instrumentalities and combinations particularly pointed out in the appended claims. Still other objects of the present invention will become readily apparent to those skilled in the art from the following description wherein there is shown and described the present preferred embodiments of this invention, simply by way of illustration of one of the modes best suited to carry out this invention. As it will be realized, this invention is capable of other different embodiments, and its several details, and specific components, are capable of modification in various aspects without departing from the invention. Accordingly, the drawings and descriptions should be regarded as illustrative in nature and not as restrictive.

BRIEF DESCRIPTION OF DRAWINGS

The accompanying drawings incorporated in and forming a part of the specification, illustrate the preferred embodiments of the invention presently known to the inventor. Some, although not all, alternative embodiments are described in the following description. In the drawings.

Reference will now be made in detail to the present preferred embodiment of the invention, an example of which is illustrated in the accompanying drawings.

DETAILED DESCRIPTION

Generally, during the game of golf it is often necessary to mark the location of the player's golf ball on the green, after which the ball is removed from the green, only to be returned to the marked location when it is the golfer's turn to putt. This is typically done in order to permit another golfer to make his or her putt without risking contact with another golfer's ball. The marking of the ball's location is usually accomplished through a somewhat ad hoc method. For example, golfers may place a coin, a tee, a piece of paper or some debris at the ball's location. Naturally, such devices have limitations and deficiencies when it comes to being used as a ball position marker. A coin may fall between the blades of longer grass losing its specific location and may still serve as an obstacle to another golfer's putt. A tee or other debris may also remain an obstacle while being somewhat imprecise for marking. Paper or other similar devices can easily be lost or change locations, especially in less than ideal weather conditions. In all of these devices a golfer is required to have or find an item that will work on an ad hoc basis. Also, many existing marking devices tend to become litter on the course. Such litter both diminishes the esthetics of the course and can be harmful to the green and/or grounds keeping equipment.

This invention is a device that provides an easy way to accurately mark a ball's location on the green of a golf course that will not interfere with or is an obstacle to another golfers putt. This invention works by dispensing a powder; chalk, baking soda, flour and the like, on the desired green location in a controlled and easy to use manner. The present invention is provided in two embodiments: a hand held sized embodiment and a golf club handle embodiment. Each embodiment includes a container for holding the powder, a removable container cap with a ball opening, and a spring-loaded ball. In order to release powder the ball is pressed (typically by contact with the ground), compressing the spring and uncovering the opening in the cap, thereby permitting the powder to fall from the container onto the ground. When the ball is released, the spring forces the ball back into the ball opening, thereby closing the opening and ending the release of the powder. Additional detail on the present preferred embodiments of this invention is shown in the figures and is described below.

Figure 1:
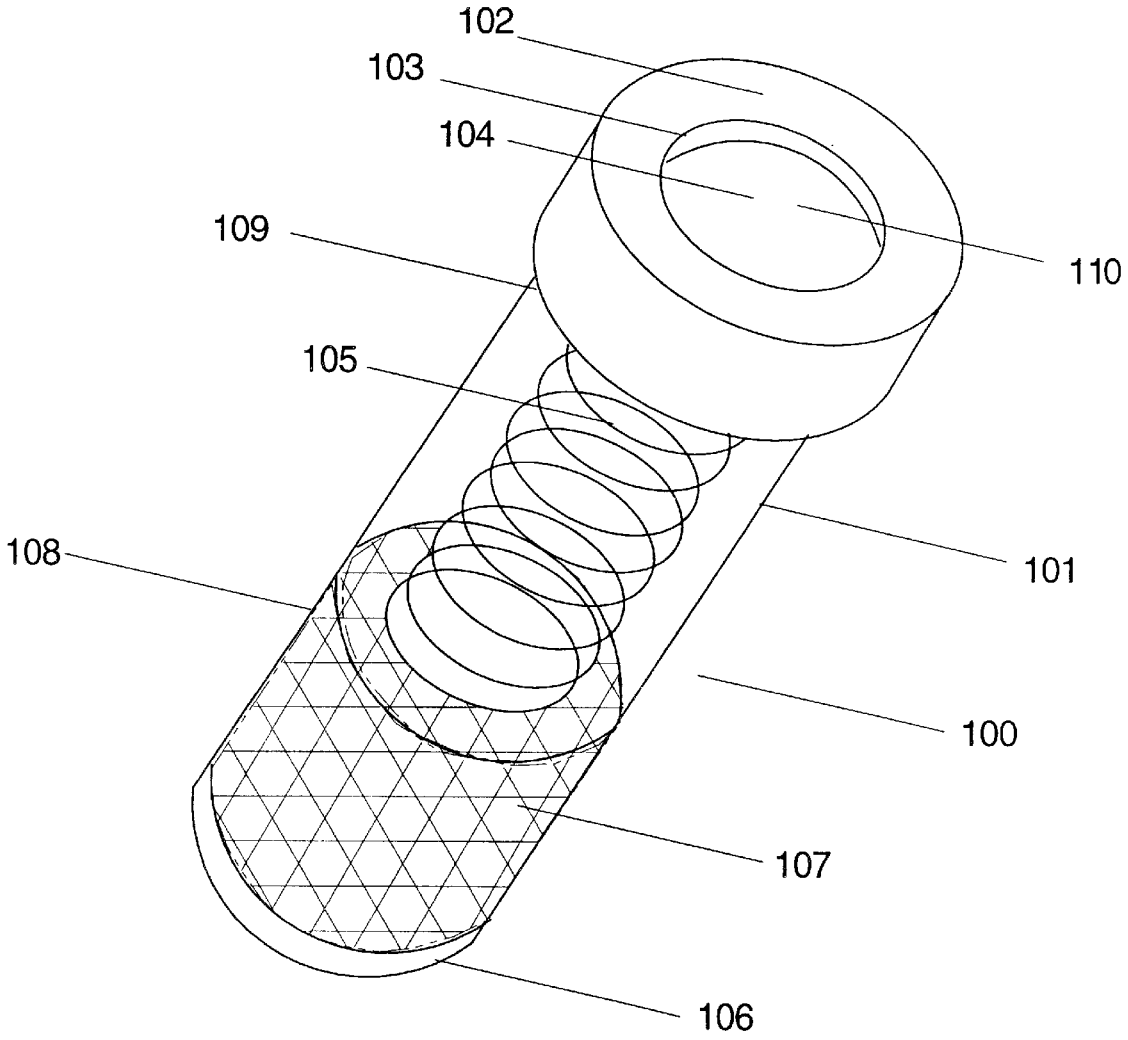
FIG. 1 is a perspective view of the hand-sized embodiment of this invention.

FIG. 1 shows a perspective view of the hand-sized embodiment 100 of this invention. A powder container 101, which in its present preferred embodiment is a generally transparent plastic tube, composed of a side wall 108, a bottom 106 and an open top 109, although in alternative embodiments can be made of another composite material, metal, glass, cardboard, and/or stiffened paper products or the like. Although it is desirable that the container 101 be transparent in order to permit a user to easily identify the quantity of powder available, alternative embodiments need not be transparent in order to function. Also, alternative shaped containers, including spherical, cylindrical, rectangular box shapes or the like can be substituted with departing from the concept of this invention. Within the container 101 is a quantity of powder 107. The powder 107 is preferably a chalk, a water-soluble mixture, or a biodegradable substance. The powder 107 preferably is granulized and colored so as to contrast with the color of the turf of the green. Typically, the powder 107 is a white chalk, although alternatives, as noted above, can be substituted without departing from the concept of this invention. Also located within the container is a spring element 105. This spring 105 has one end on the inner bottom 106 of the container and the other end in contact with or placing spring pressure a ball closure 104 that is provided within the opening 103 in the cap 102 that is attached or fixed to the top 109 of the container. In alternative embodiments of this invention, the spring 105 need not extend to the bottom 106 of the container and may be extended through an extension to place force on the ball closure 104 without the spring 105 physically coming into contact with either the ball closure 104 or the bottom 106 of the container. The cap 102 may, in some embodiments, be removable to facilitate refilling of powder 107 within the container 101 or may be fixed in place on the top 109 of the container 101 by pressure fit, adhesive, clips, heat treatment, or other similar means. The ball closure 104 operates, under force from the spring 105, to keep the cap opening 103 normally closed, thereby keeping the powder 107 from being released or lost unintentionally. However, when pressure is placed on the exterior 110 of the ball closure 104, the spring 105 is compressed, exposing the opening 103 in the cap 102, thereby permitting the powder 107 to be released. Typically, the device 100 is inverted, with the pressure on the exterior 110 of the ball closure 104 being accomplished by pressing the ball closure 104 against the turf of the green. Under such circumstances, the exposed opening 103 in the cap 102 becomes the exit for the powder 107 simply by virtue of gravitational force on the powder 107. The released powder leaves a small, temporary but distinct mark on the green of the placement location of the golf ball. As soon as a small amount of powder 107 has been released, the typical user will lift the device 100 so that the ball closure 104 is no longer in contact with the turf, the spring 105 will press the ball closure 104 and the opening 103 in the cap 102 will be closed, thereby keeping further powder 107 from escaping. Since the powder 107 is typically released in small portions and is either water soluble or biodegradable, essentially no permanent marking of the green is made. In alternative embodiments of this invention, the ball closure 104 need not necessarily be a ball. Any number of other shapes, including but not limited to, cones, pyramids, other more complex combinations of three-dimensional shapes can be substituted without departing from the concept of this invention. A ball closure 104 is presently used in the preferred embodiment for the sake of simplicity.

Figure 2A:
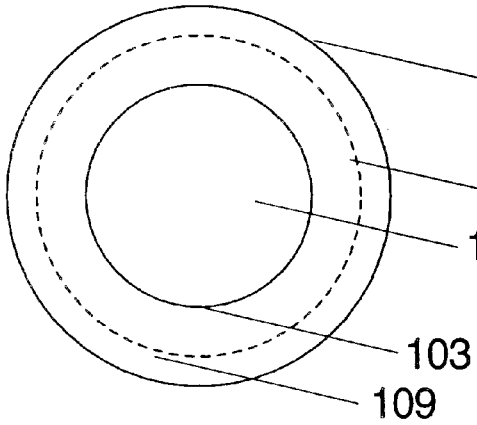
FIGS. 2*a*, 2*b* and 2*c* are top, side and bottom view of the hand-sized embodiment of this invention.
Figure 2C:
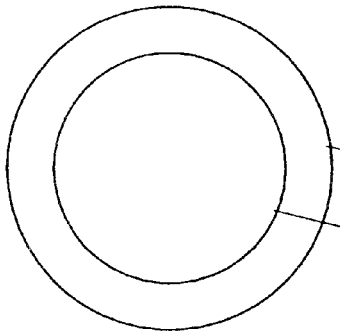
Figure 2B:
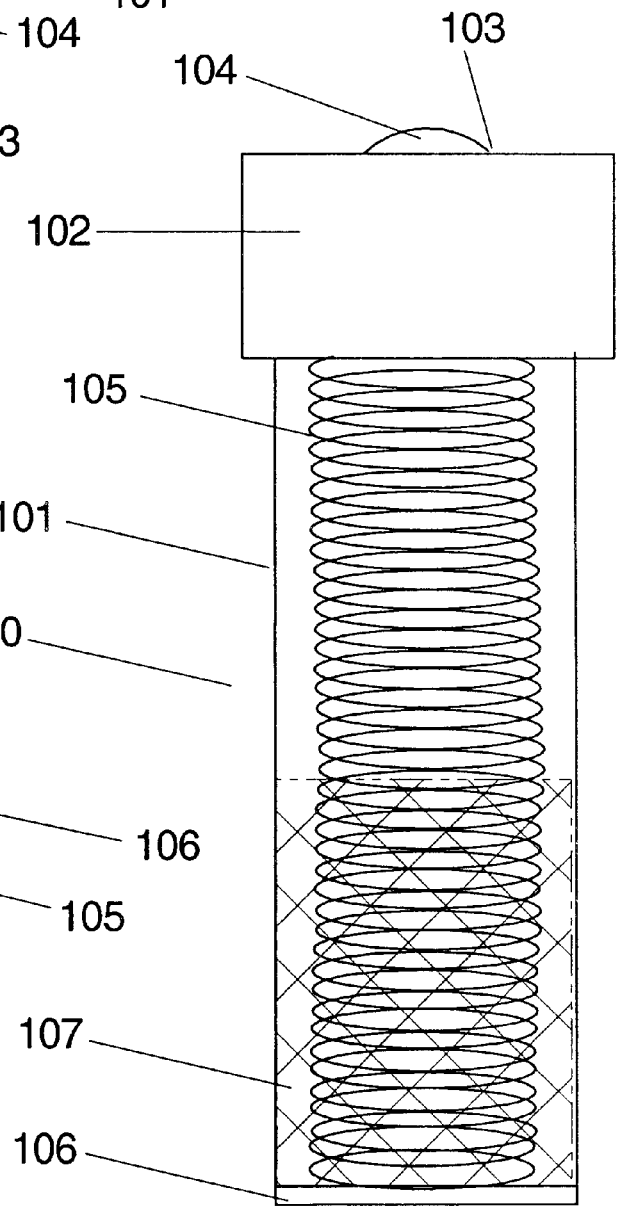

FIGS. 2*a*, 2*b* and 2*c* show top, side and bottom view of the present hand sized embodiment 101 of this invention. In the top view, of FIG. 2*a*, the ball closure 104 is shown within the cap opening 103, which is located approximately in the center of the cap 102. In this embodiment, the cap 102 is fixed to the top 109 of the container 101, shown here as a dotted line within the cap. FIG. 2*b*, shows the side view of this present embodiment 100 of the invention. This view, FIG. 2*b*, better shows the extent of the spring 105, which in this embodiment extends, within the container 101, from the ball closure 104 to the bottom 106 of the container 101. FIG. 2*c* shows the present bottom 106 of the container 101. As can be seen, in this present embodiment 100, the container 101 is generally cylindrical in shape. When the container 101 is in an upright position, the powder 107 tends to settle towards the bottom 106 of the container and will generally fill some but not all of the interior of the container 101.

Figure 3:
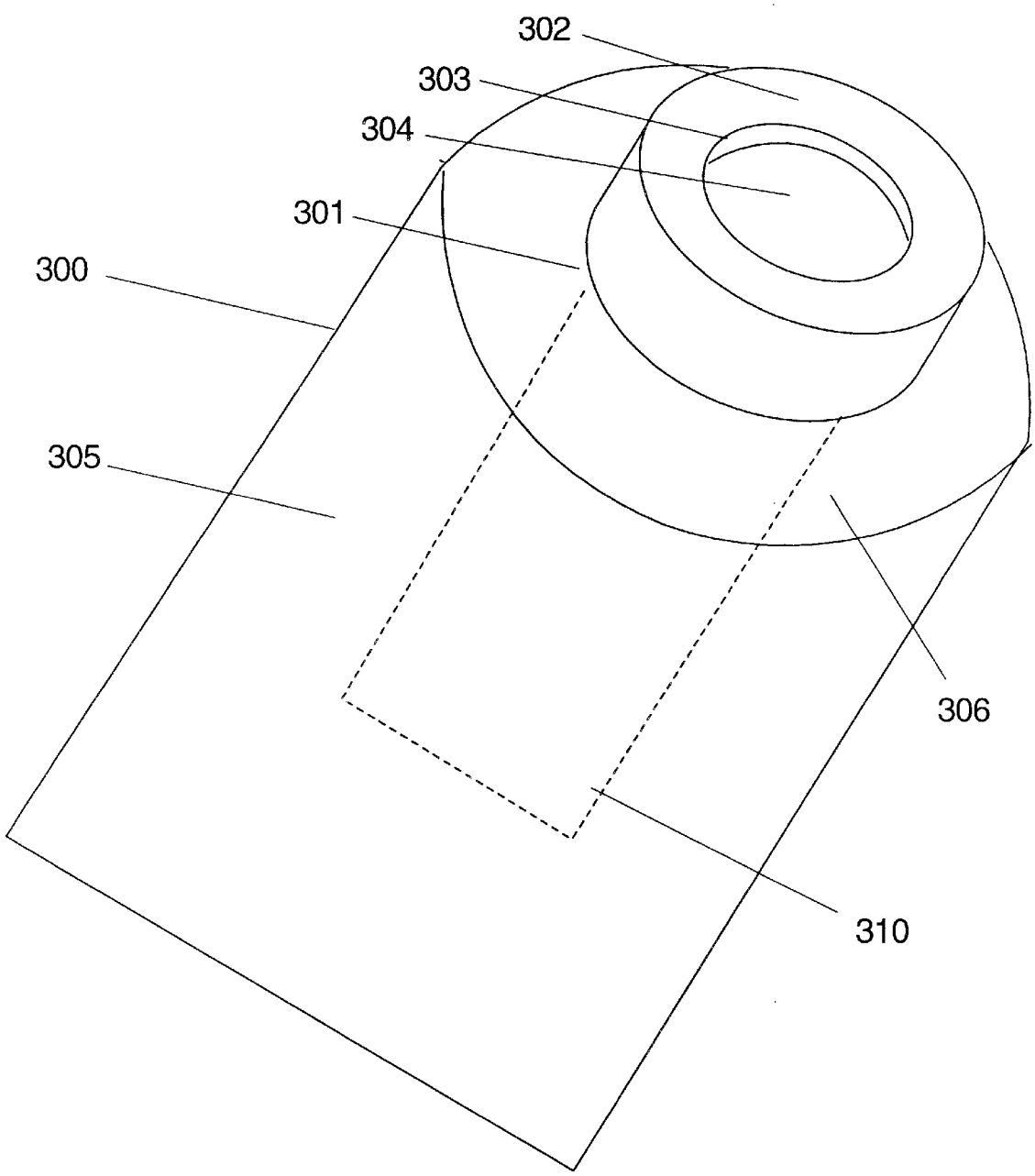
FIG. 3 is a perspective view of the golf club embodiment of this invention.

FIG. 3 shows a perspective view of the golf club embodiment of this invention. In this embodiment 300, the marker device 310, while generally constructed in a manner similar to that described above, is fitted into a cavity 301 in the top of a standard golf club or other pole 305. The cap 302 extends from the top surface 306 of the club or pole 305, with the ball closure 304 in place normally closing off the opening 303. In use, the club or pole 305 is inverted, with the golfer pressing the spring loaded ball closure 304 against the turf of the green, exposing the opening 303 and permitting the powder to escape.

Figure 4:
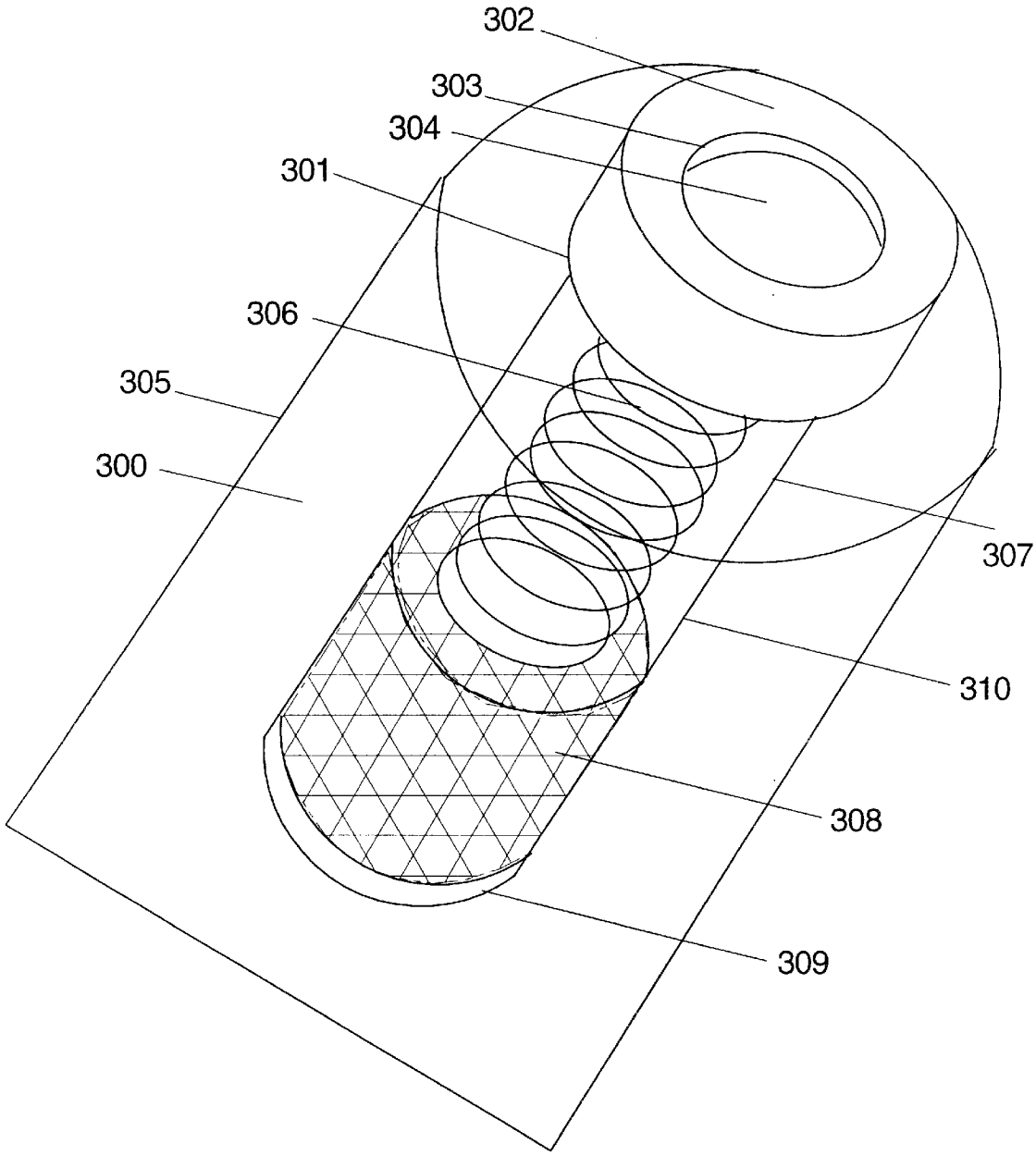
FIG. 4 is a cut-away view of the golf club embodiment of this invention.

FIG. 4 shows a cut-away view of the golf club embodiment 300 of this invention. This view shows the detail of the present marker device within the cavity 301 of the club or pole 305. The powder 308 is shown inside the container 307, normally settled toward the bottom 309 of the container 307, and the spring 306 is shown to apply spring pressure on the ball closure 304, thereby keeping the opening 303 in the cap 302 normally closed. In the present preferred golf club embodiment 300 of this invention the marker device 310 is removable and replaceable, typically, although not exclusively, by gripping the cap 302 and drawing the cap 302 along with the rest of the marking device 301 outward from the handle of the club or pole 305.

It is to be understood that the above described and referenced embodiments and examples are merely illustrative of numerous and varied other embodiments and applications, which may constitute applications of the principles of the invention. These example embodiments are not intended to be exhaustive or to limit the invention to the precise form, connection or choice of components disclosed herein as the present preferred embodiments. Obvious modifications or variations are possible and foreseeable in light of the above teachings. These embodiments of the invention were chosen and described to provide the best illustration of the principles of the invention and its practical application to thereby enable one of ordinary skill in the art to make and use the invention, without undue experimentation. Other embodiments may be readily devised by those skilled in the art without departing from the spirit or scope of this invention, as determined by the appended claims when they are interpreted in accordance with the breadth to which they are fairly, legally and equitably entitled.

What is claimed is:

1. A golf ball location marker, comprising:

(A) a container, having a top and a peripheral wall, said container being adapted to be removably and replaceably received within a cavity of a golf club;

(B) a cap attached to said top of said container, wherein said cap further comprises an opening, and wherein said cap provides the mechanism for removal of said container from said cavity in said golf club;

(C) a cover for covering said opening of said cap;

(D) a spring within said container to provide force to hold normally closed said cover over said opening; and (E) a powder within said container, wherein said powder is releasable by moving said cover from said opening of said cap.

2. A golf ball location marker, as recited in claim 1, wherein said container has a generally cylindrical shape.

3. A golf ball location marker, as recited in claim 1, wherein said container further comprises a bottom and wherein said spring is in physical contact with said bottom of said container.

4. A golf ball location marker, as recited in claim 1, wherein said cover has a shape selected from the group consisting of spherical, conical, and pyramidal.

5. A golf ball location marker, as recited in claim 1, wherein said powder is selected from the group consisting of chalk, flour, sand, and a colored chemical composition.

6. A golf ball location marker, as recited in claim 1, wherein said cap is removable to allow refilling of said container.

7. A golf ball location marker, as recited in claim 1, wherein said container is generally transparent.

8. A golf ball location marker, comprising:

(A) a pole having a first end and a second end and having a cavity in said first end;

(B) a container, having a top and a peripheral wall, within said cavity being located in said first end of said pole and said container being adapted to be removably and replaceably received within said cavity of said pole;

(C) a cap attached to said top of said container, wherein said cap further comprises an opening, and wherein said cap provides the mechanism for removing said container from said cavity of said pole;

(D) a cover for covering said opening of said cap;

(E) a spring within said container to provide force to hold normally closed said cover over said opening; and (F) a powder within said container, wherein said powder is releasable by moving said cover from said opening of said cap.

9. A golf ball location marker, as recited in claim 8, wherein said container has a generally cylindrical shape.

10. A golf ball location marker, as recited in claim 8, wherein said container further comprises a bottom and wherein said spring is in physical contact with said bottom of said container.

11. A golf ball location marker, as recited in claim 8, wherein said cover has a shape selected from the group consisting of spherical, conical, and pyramidal.

12. A golf ball location marker, as recited in claim 8, wherein said powder is selected from the group consisting of chalk, flour, sand, and a colored chemical composition.

13. A golf ball location marker, as recited in claim 8, wherein said cap is removable to allow refilling of said container.

14. A golf ball location marker, as recited in claim 8, wherein said container is generally transparent.

15. A golf ball location marker, comprising:

(A) a golf club having a handle and having a cavity in said handle;

(B) a container, having a top and a peripheral wall, said container being removably and replaceably received within said cavity of said golf club;

(C) a cap attached to said top of said container, wherein said cap further comprises an opening, wherein said cap provides the mechanism for removing said container from said cavity in said golf club;

(D) a cover for covering said opening of said cap;

(E) a spring within said container to provide force to hold normally closed said cover over said opening; and (F) a powder within said container, wherein said powder is releasable by moving said cover from said opening of said cap.

16. A golf ball location marker, as recited in claim 15, wherein said container has a generally cylindrical shape.

17. A golf ball location marker, as recited in claim 15, wherein said container further comprises a bottom and wherein said spring is in physical contact with said bottom of said container.

18. A golf ball location marker, as recited in claim 15, wherein said cover has a shape selected from the group consisting of spherical, conical, and pyramidal.

19. A golf ball location marker, as recited in claim 15, wherein said powder is selected from the group consisting of chalk, flour, sand, and a colored chemical composition.

20. A golf ball location marker, as recited in claim 15, wherein said cap is removable to allow refilling of said container.

* * * * *